United States Patent [19]

Fujimori

[11] Patent Number: 4,960,030

[45] Date of Patent: Oct. 2, 1990

[54] AUTOMATIC MUSICAL PERFORMANCE APPARATUS HAVING REDUCED WAIT TIME

[75] Inventor: Junichi Fujimori, Hamamatsu, Japan

[73] Assignee: Yamaha Corporation, Hamamatsu, Japan

[21] Appl. No.: 453,059

[22] Filed: Dec. 13, 1989

Related U.S. Application Data

[63] Continuation of Ser. No. 52,036, May 18, 1987, abandoned.

[30] Foreign Application Priority Data

May 23, 1986 [JP] Japan ..... 61-118744

[51] Int. Cl.[5] ..... G10H 1/36; G10H 7/00

[52] U.S. Cl. ..... 84/609; 84/649

[58] Field of Search ..... 84/609–614, 84/634–638, 649–652, DIG. 12, DIG. 22, DIG. 29; 360/91

[56] References Cited

U.S. PATENT DOCUMENTS

| | | | |
|---|---|---|---|
| 3,415,956 | 12/1968 | Uchikoshi | 360/91 |
| 3,951,028 | 4/1976 | Robinson | 84/1.01 |
| 4,476,766 | 10/1984 | Ishii | 84/1.28 X |
| 4,587,878 | 5/1986 | Nakada et al. | 84/1.28 X |
| 4,614,144 | 9/1986 | Sagara et al. | 84/1.28 |
| 4,641,564 | 2/1987 | Okamoto | 84/1.22 |
| 4,681,008 | 7/1987 | Morikawa et al. | 84/1.28 |

*Primary Examiner*—Stanley J. Witkowski
*Attorney, Agent, or Firm*—Spensley Horn Jubas & Lubitz

[57] ABSTRACT

An automatic musical performance apparatus for an electronic musical instrument provides a buffer memory and a recording medium. The automatic musical performance apparatus further includes a microcomputer for executing programs for read-out and write-in operations of the buffer memory and the recording medium. The musical performance data groups generated by the electronic musical instrument are temporarily stored in the buffer memory and are transferred to the recording medium wherein the musical performance data are recorded thereon. At this time, the microcomputer detects transfer control information corresponding to a data quantity which indicates the data quantity transferred in a unit time. This transfer control information is recorded at a predetermined area of the recording medium. Next, first musical performance data group of the data quantity is read from the recording medium and is stored in the buffer memory before the musical performance data groups are reproduced. Thereafter, remaining musical performance data groups other than the first musical performance data group are sequentially stored in the buffer memory as the previously stored musical performance data groups are read from the buffer memory and are reproduced.

14 Claims, 14 Drawing Sheets

| MARK DATA | DATA CONTENT (MSB) | | | | | | | |
|---|---|---|---|---|---|---|---|---|
| ○ UK KEY–ON | 1 | 0 | 0 | 0 | 1 | 0 | 0 | 1 |
| ○ LK KEY–ON | 1 | 0 | 0 | 0 | 1 | 0 | 1 | 0 |
| ○ PK KEY–ON | 1 | 0 | 0 | 0 | 1 | 0 | 1 | 1 |
| ○ UK KEY–OFF | 1 | 0 | 0 | 0 | 1 | 1 | 0 | 1 |
| ○ LK KEY–OFF | 1 | 0 | 0 | 0 | 1 | 1 | 1 | 0 |
| ○ PK KEY–OFF | 1 | 0 | 0 | 0 | 1 | 1 | 1 | 1 |
| ○ RELATIVE TIME | 1 | 0 | 0 | 0 | 0 | 0 | 0 | 1 |
| ○ INITIAL TOUCH | 1 | | | | | | | |
| ○ AFTER TOUCH | 1 | | | | | | | |
| ○ EXP PEDAL | 1 | | | | | | | |
| ○ OPERATING MEMBER I | 1 | | | | | | | |
| ○ OPERATING MEMBER II | 1 | | | | | | | |
| ○ OPERATING MEMBER III | 1 | | | | | | | |
| ○ END | 1 | 1 | 1 | 1 | 1 | 1 | 1 | 1 |

FIG.4

AUTOMATIC MUSICAL PERFORMANCE APPARATUS HAVING REDUCED WAIT TIME

This is a continuation of copending application Ser. No. 07/052,036 filed on 5/18/87 and now abandoned.

BACKGROUND OF THE INVENTION

1. Field of the Invention

The present invention generally relates to automatic musical performance apparatuses for recording musical performance data onto a recording medium such as a magnetic disk and for reproducing the musical performance data from the recording medium by use of a buffer memory such as a random access memory (RAM), and more particularly to an automatic musical performance apparatus for efficiently controlling a data transfer between the recording medium and the buffer memory so as to shorten a wait time before the musical performance data can be reproduced.

2. Prior Art

Conventionally, automatic musical performance apparatuses for using a buffer memory and a floppy disk are well known. In a first type of automatic musical performance apparatuses, musical performance data (or musical performance information) are produced by playing an electronic musical instrument, and this musical performance data are passed through the buffer memory and are stored in the floppy disk which is later read for playing such automatic musical performance apparatuses. When the conventional automatic musical performance apparatus is played, a predetermined quantity of the musical performance data is pre-transferred to the buffer memory, and thereafter, remaining musical performance data are sequentially transferred from the floppy disk to the buffer memory while the pre-transferred musical performance data are sequentially read from the buffer memory and are reproduced. Hence, the musical tone corresponding to the reproduced musical performance data is generated. In this conventional automatic musical performance apparatus, a wait time is inevitably generated between a start time for playing the automatic musical performance apparatus and another start time for reproducing the musical performance data.

In a second type of conventional automatic musical performance apparatus, all of the musical performance data stored in the floppy disk are transferred to the buffer memory, and thereafter, the musical performance data are read from the buffer memory and are reproduced.

The first type of conventional automatic musical performance apparatus is superior to second type of conventional automatic musical performance apparatus in that the wait time becomes shorter and the storage of the buffer memory becomes smaller.

However, the predetermined quantity of the musical performance data described above is set constant throughout all tunes which are played in the first type of conventional automatic musical performance apparatus. Hence, the first type of conventional automatic musical performance apparatus suffers a disadvantage in that the wait time becomes longer when the tunes with less tune data are played.

In this case, an average transfer speed Va is defined by a formula $Va=E/T$, where E denotes a number of events such as a key-on and a key-off occurred at playing and T denotes a time required for playing. The first type of conventional automatic musical performance apparatus sets the predetermined quantity of the musical performance data to a relatively large quantity in order to play a tune having a large average transfer speed Va. Hence, the wait time becomes longer when a tune having small average transfer speed Va is played.

SUMMARY OF THE INVENTION

It is therefore a general object of the present invention to provide an automatic musical performance apparatus in which the wait time is pre-determined based on the average transfer speed corresponding to the tune which will be played.

It is another object of the present invention to provide an automatic musical performance apparatus for shortening the wait time especially when a tune having a small average transfer speed is played.

According to one aspect of the present invention, there is provided an automatic musical performance apparatus comprising (a) a memory for writing in musical performance data groups supplied from the electronic musical instrument and for reading out the musical performance data groups; (b) a recording medium for recording the musical performance data groups which are transferred from the memory; (c) writing means for sequentially writing the musical performance data groups into the memory; (d) first recording means for recording the musical performance data groups on the recording medium, the musical performance data groups being read from the memory in parallel with a write-in operation of the writing means; (e) detecting means for detecting transfer control information which are determined in response to a unit data quantity of the musical performance data groups which are transferred in a unit time when the electronic musical instrument is played; (f) second recording means for recording the transfer control information on a predetermined area arranged on the recording medium; (g) first transfer means for reading out the transfer control information from the recording medium before the musical performance data groups are reproduced, first musical performance data group of the unit data quantity within the musical performance data groups being read from the recording medium and being written into the memory in a wait time; (h) second transfer means for sequentially reading out remaining musical performance data groups other than the first musical performance data group from the recording medium after the wait time is passed away; and (i) reproducing means for reproducing the musical performance data groups which are sequentially read from the memory after the wait time is passed away.

BRIEF DESCRIPTION OF THE DRAWINGS

Further objects and advantages of the present invention will be apparent from the following description, reference being had to the accompanying drawings wherein preferred embodiment of the present invention is clearly shown.

In the drawings:

FIG. 4 shows an illustration indicating an example of contents of several kinds of mark data;

DESCRIPTION OF THE PREFERRED EMBODIMENT OF THE INVENTION

Figure 1:
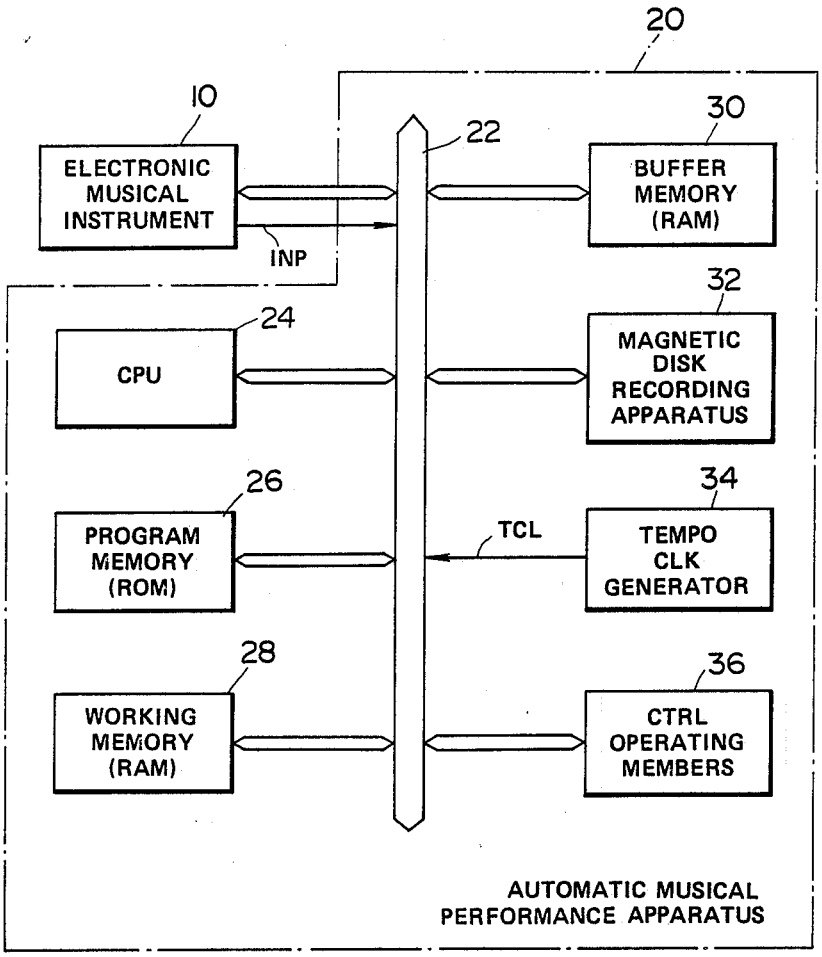
FIG. 1 is a block diagram showing a constitution of an automatic musical performance apparatus of an embodiment according to the invention.

Referring now to the drawings, wherein like reference characters designate like or corresponding parts throughout the several views.

FIG. 1 shows a constitution of an automatic musical performance apparatus of an embodiment according to the present invention. This automatic musical performance apparatus performs and controls the recording process and the reproducing process by use of a micro computer, for example.

Figure 2:
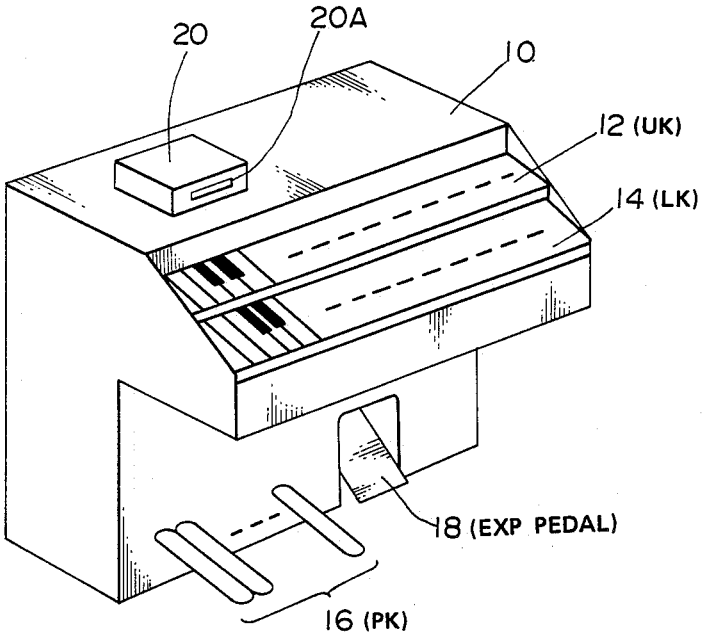
FIG. 2 is a perspective side view showing an electronic musical instrument providing the invention thereon.

WHOLE CONSTITUTION OF THE EMBODIMENT (shown in FIGS. 1 and 2)

An electronic musical instrument 10 is provided for inputting and outputting the musical performance data with an automatic musical performance apparatus 20. The electronic musical instrument 10 is provided with an upper keyboard (UK) 12, a lower keyboard (LK) 14, a pedal keyboard (PK) 16 and an expression pedal (EXP) 18 and other members. The automatic musical performance apparatus 20 becomes available when such apparatus 20 is put on the electronic musical instrument 10 as shown in FIG. 2. The automatic musical performance apparatus 20 is provided with an opening portion 20A for attaching a magnetic disk such as a floppy disk therein.

In FIG. 1, a bus 22 is connected to the electronic musical instrument 10, a central processing unit (CPU) 24, a program memory 26 comprised of a read only memory (ROM), a working memory 28 comprised of the RAM, a buffer memory 30 comprised of the RAM, a magnetic disk recording apparatus 32, a tempo clock generator 34 and control operating members 36.

The electronic musical instrument 10 supplies a series of musical performance data to the bus 22 based on a musical performance and also supplies an interruption command pulse INP of each musical performance data to the bus 22. The interruption command pulse INP is used for starting an event interruption routine shown in FIG. 8.

The CPU 24 performs recording and reproducing processes according to programs stored in the program memory 26. Later, description with respect to these processes of the CPU 24 will be given in conjunction with FIG. 5 to FIG. 11.

The working memory 28 is constituted by a plurality of recording areas used as the register, the pointer and the flag when the processes of the CPU 24 are performed. Later, description with respect to registers will be given.

The buffer memory 30 temporarily stores the musical performance data when recording and reproducing. The contents of stored data in the buffer memory 30 will be described later in conjunction with FIGS. 3 and 4.

The magnetic disk recording apparatus 32 is attached with the magnetic disk such as the floppy disk therein. The musical performance data is recorded on and reproduced from the magnetic disk.

The tempo clock generator 34 generates a tempo clock pulse TCL based on a tempo and supplies the tempo clock pulse TCL to the bus 22. The tempo clock pulse TCP is used as a interruption command signal for starting a tempo interruption routine shown in FIGS. 10A and 10B.

The control operating members 36 include several kinds of operating members for controlling a musical tone (operating members for setting a tone-color and an tone effect, for example), several kinds of switches for controlling the recording and reproducing. Operating information will be detected by each control operating member. The switches for controlling the recording and reproducing includes a recording switch, a recording stop switch, a reproducing switch and a reproducing stop switch.

Figure 3:
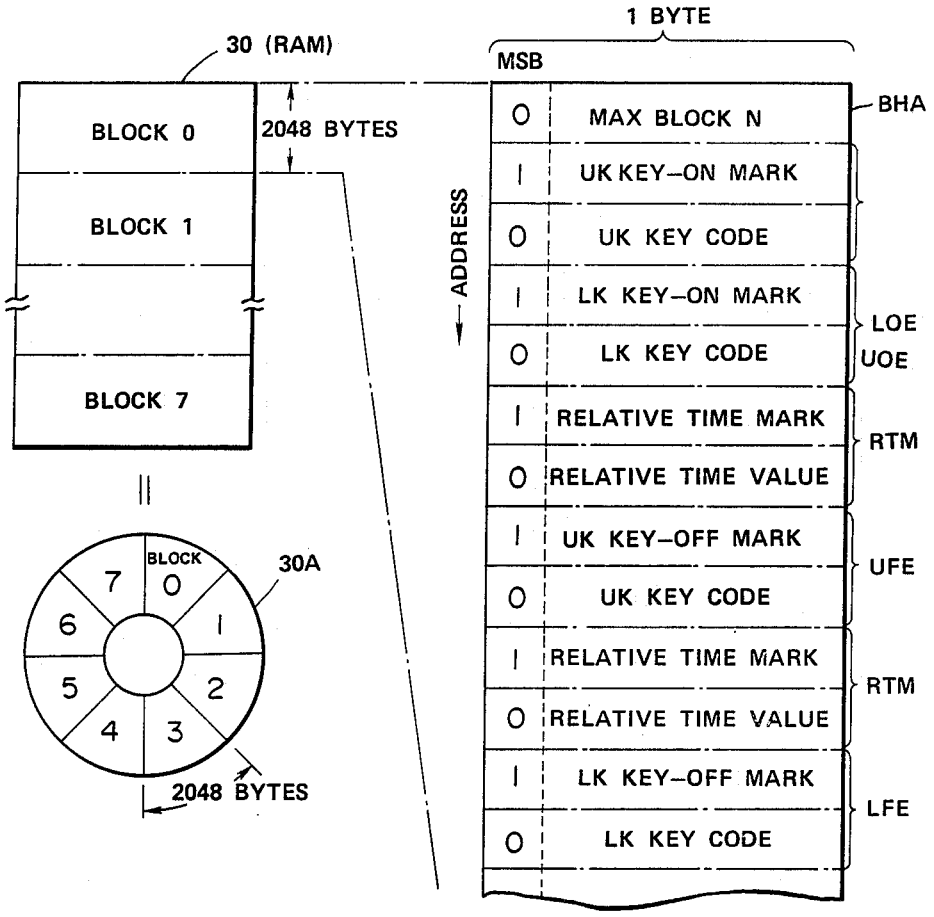
FIG. 3 shows an illustration of the buffer memory and stored data thereof.

CONTENTS OF STORED DATA IN BUFFER MEMORY (shown in FIG. 3 and FIG. 4)

FIG. 3 shows an example of stored data in the buffer memory 30 having eight blocks 0 to 7, each of which can store data of 2048 bytes. As blocks "30A" shown in FIG. 3, the write-in and read-out operations of the memory 30 are performed in a sequence of blocks 0, 1, 2, . . . , and 7. Thereafter, the above operations are returned to the block 0 again and the memory 30 repeats the above operations, in other words, the memory 30 works as a so-called ring buffer.

The data indicating a maximum block number MAX is stored in a head address BHA of the block 0 within the memory 30. The maximum block number MAX means the number of blocks corresponding to a maximum quantity of a series of data existed in the memory 30 when recording the musical performance data, and detailed description thereof will be given later. The maximum block number MAX is not stored in the other blocks 1 to 7.

The musical performance data including Uk on-event data UOE, LK on-event data LOE, relative time data RTM, UK off-event data UFE and LK off-event data LFE are stored in addresses next to the head address BHA of the block 0 according to musical performance contents. Similarly, the musical performance data are stored in other blocks 1 to 7.

The stored data of one address is data of one byte. This data will mean mark data when the most significant bit MSB thereof is "1", and this data will mean control quantity data when the most significant bit MSB thereof is "0". The on-event data such as UOE and LOE is constituted by data of two bytes whose first byte is key-on mark data indicating that a key-on event (key-depression event) has arisen and whose second byte is key code data indicating a key code identitying a depressed key. In this case, it is possible to add initial touch data and after touch data for controlling an envelope of a tone of a depressed key in accordance with a degree of a key depression corresponding to each on-event data. The initial touch data is comprised of initial touch mark data of one byte and initial touch quantity data of one byte, and the after touch data is comprised of after touch mark data of one byte and after touch quantity data of one byte.

The off-event data such as UFE and LFE is constituted by data of two byte whose first byte is key-off mark data indicating that the key-off event (key-release event) has arised and whose second byte is key code data indicating a key code of a released key.

Each relative time data RTM means a relative time between events such as the key-on event, key-off event and an operating event of a control operating member. The relative time data RTM is comprised of data of two byte whose first byte is relative time mark data and whose second byte is relative time value data.

FIG. 4 shows examples of contents of mark data group. The binary codes of this mark data group include UK key-on, LK key-on, PK key-off, UK key-off, Lk key-off, PK key-off, the relative time, the initial touch, the after touch, the EXP pedal, the operating members I to III and end. The end mark data is arranged at the end order of the musical performance data so as to indicate the end of the musical performance data.

Figure 5:
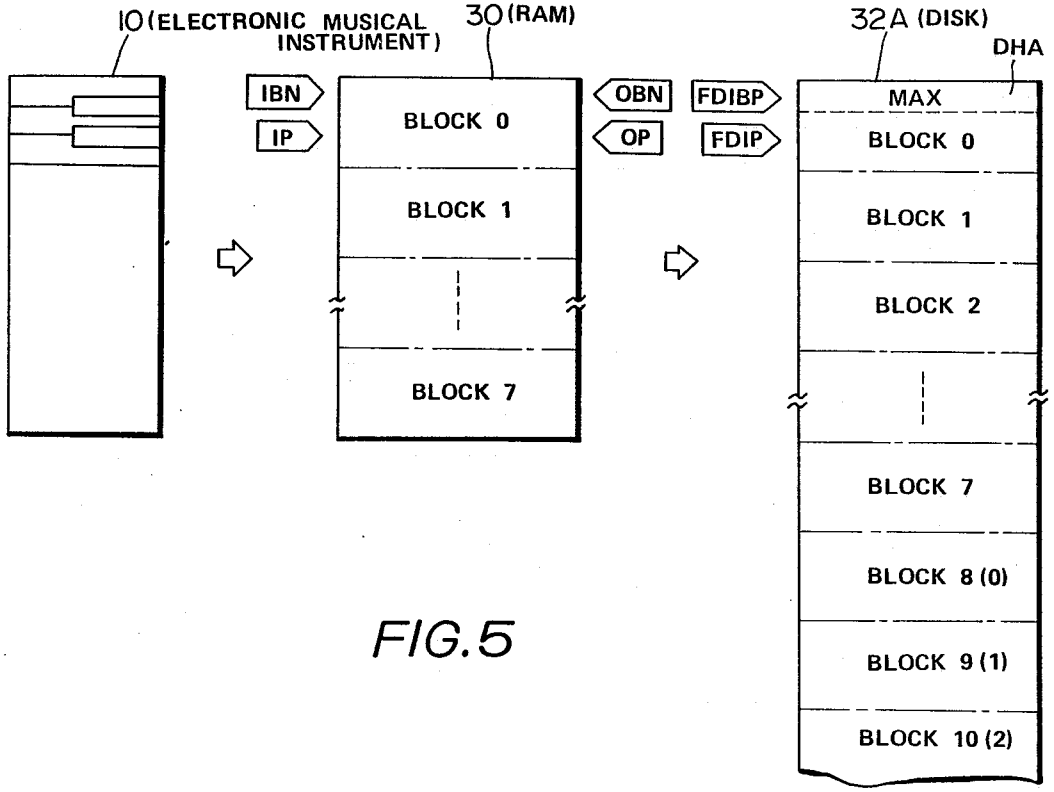
FIGS. 5 and 6 show conceptional illustrations for respectively explaining a recording process and a reproducing process according to the invention.
Figure 6:
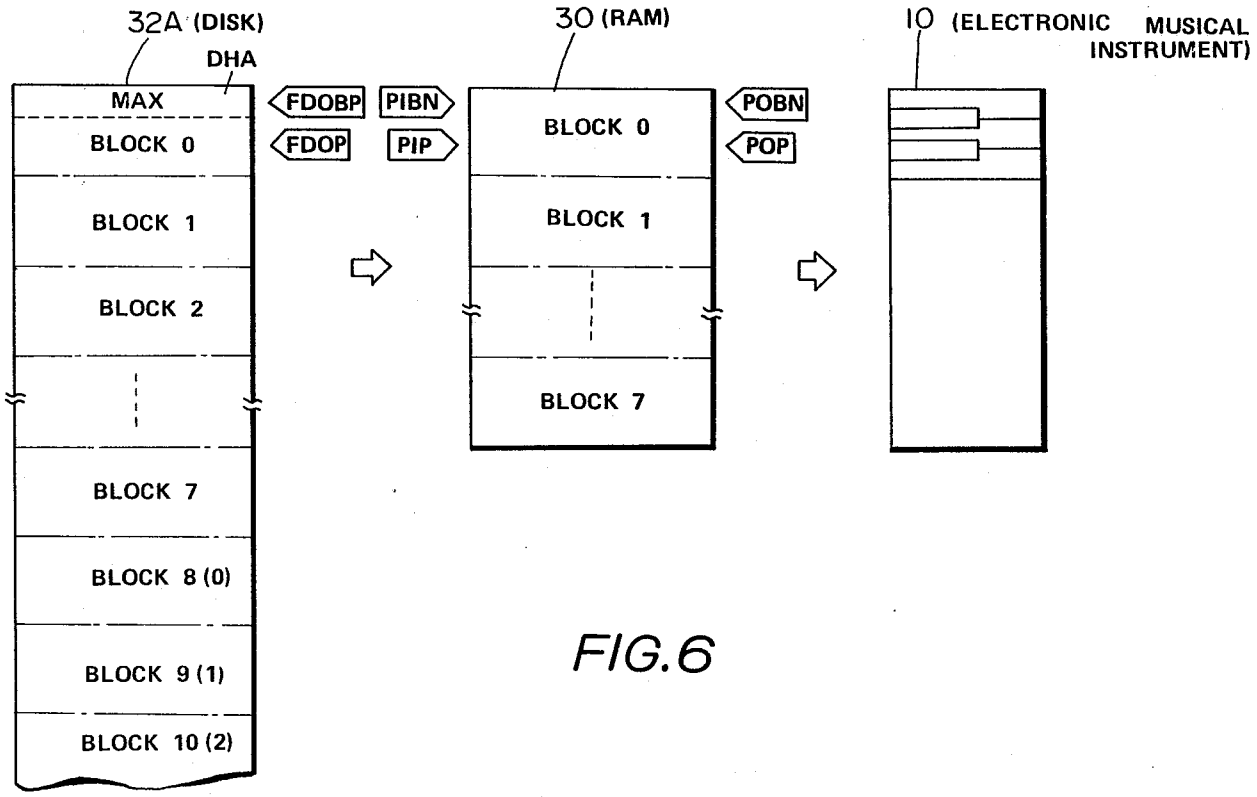

OUTLINE OF THE RECORDING AND REPRODUCING PROCESS (shown in FIG. 5 and FIG. 6)

FIG. 5 shows a conceptual illustration for explaining an outline of the recording process. The electronic musical instrument 10 generates a series of musical performance data based on a musical performance. The musical performance data is supplied to the buffer memory 30 wherein the musical performance data will be written in blocks in order from the block 0 to the block 7. In this case, write-in addresses of the musical performance data are assigned by a block pointer IBN and an address pointer IP within the block.

In parallel with above write-in operation, the memory 30 supplies the musical performance data to the magnetic disk recording apparatus 32 wherein the musical performance data is recorded on the magnetic disk 32A. The magnetic disk 32A is provided with a plurality of blocks including eight memory blocks corresponding to the blocks The maximum block number MAX is recorded in a head address DHA of the block 0 on the magnetic disk 32A, and the performance data is stored in addresses next to the head address DHA. This maximum block number MAX will be recorded after a series of musical performance data are completely recorded.

In the case where the musical performance data is transferred from the memory 30 to the disk 32A, readout addresses of the memory 30 are assigned by a block pointer OBN and an address pointer OP within the block, and recording addresses of the disk 32A are assigned by a block pointer FDIBP and an address pointer FDIP within the block.

The above pointers IBN, IP, OBN, OP, FDIBP and FDIP are provided in the working memory 28.

FIG. 6 is a conceptional illustration for explaining an outline of the reproducing process. First, the maximum block number MAX is read from the head address DHA of the disk 32A. A series of musical performance data of (MAX+1) blocks are read from the disk 32A and are written into the memory 30. At this time, readout addresses of the disk 32A are assigned by a block pointer FDOBP and an address pointer FDOP within the block, and write-in addresses of the memory 30 are assigned by a block pointer PIBN and an address pointer PIP within the block.

A series of musical performance data of the (MAX+1) blocks are completely written into the memory 30, and thereafter, a series of remaining musical performance data are read from the disk 32A and are written into the memory 30. In this case, the pointers FDOBP, FDOP, PIBN and PIP are used in the recording and reproducing processes. During these recording and reproducing processes, a series of previously stored musical performance data are sequentially read from the memory 30. These musical performance data are reproduced by controlling a musical tone generating operation of the electronic musical instrument 10. In this case, read-out addresses of the memory 30 are assigned by a block pointer POBN and an address pointer POP within the block.

The above-mentioned pointers FDOBP, FDOP, PIBN, PIP, POBN and POP are provided in the working memory 28.

Figure 7A:
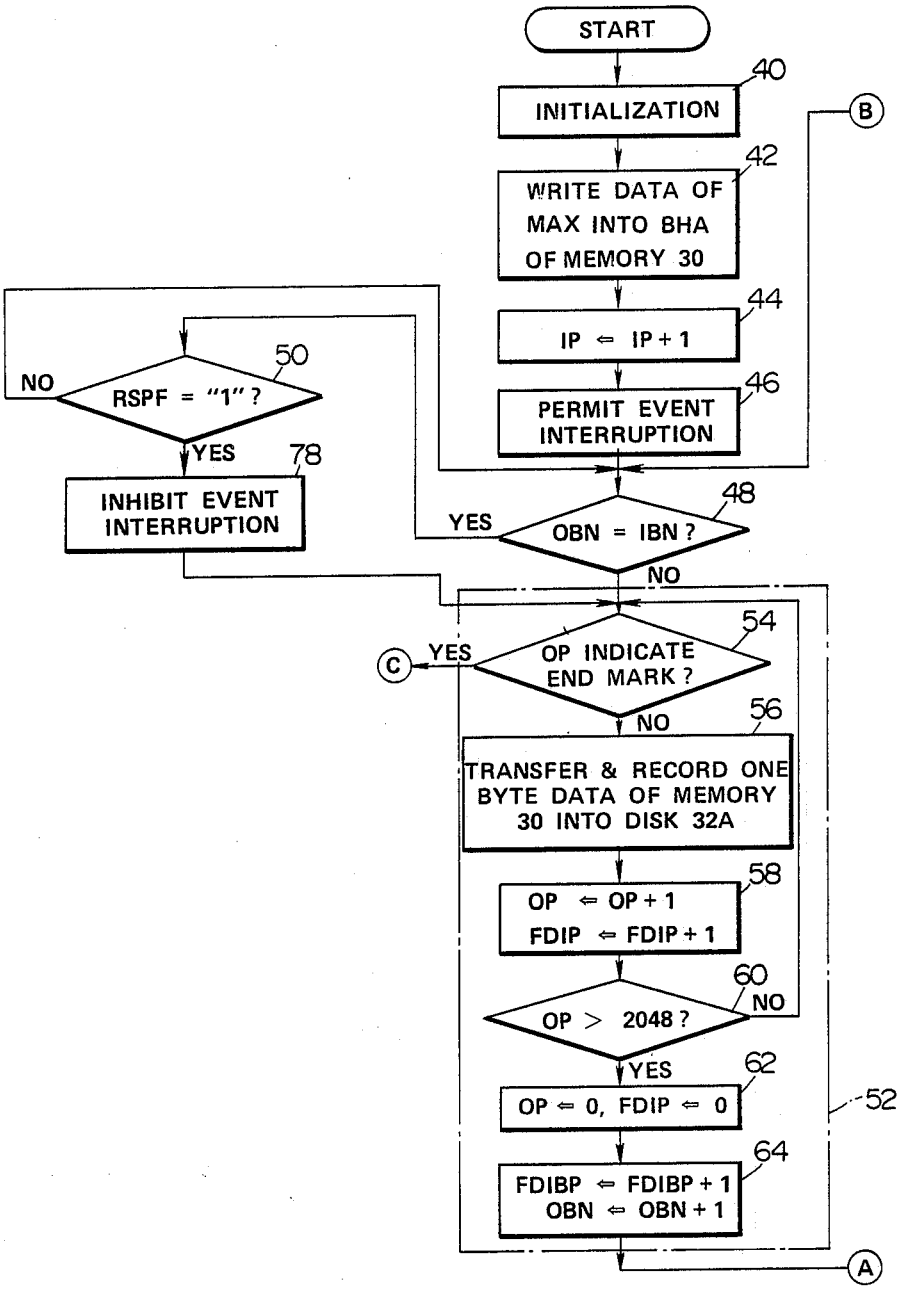
FIGS. 7A to 7C are flow charts showing a main routine of the recording process.
Figure 7B:
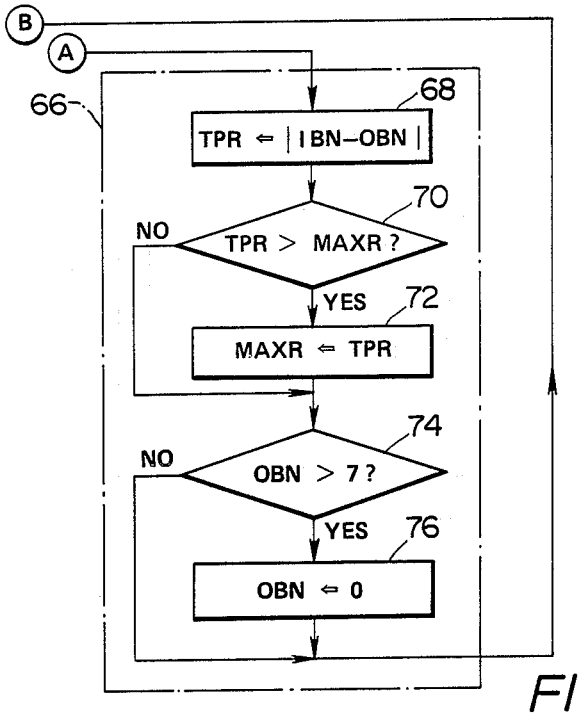
Figure 7C:
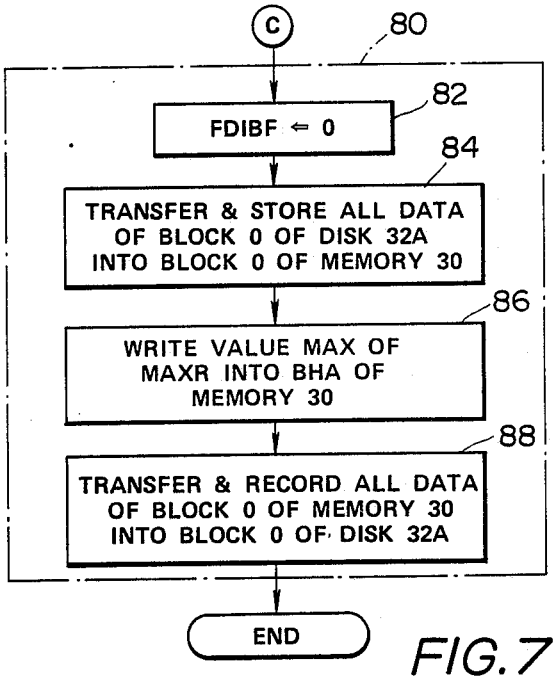

MAIN ROUTINE OF THE RECORDING PROCESS (shown in FIGS. 7A to 7C)

FIGS. 7A to 7C are flow charts showing a main routine of the recording process. This recording process is started by turning a recording switch (not shown) on.

An initialization process is performed in a step 40 in FIG. 7A. More specifically, the buffer memory 30 is cleared and the magnetic disk recording apparatus 32 becomes able to record the data in the step 40. In addition, registers in the working memory 28 are initialized. The value "0" is set to all of the pre-mentioned pointers IBN, IP, OBN, OP, FDIBP and FDIP, and furthermore, the value "0" is set respectively to a temporary register TPR, a maximum block number register MAXR and a recording stop flag RSPF. The registers TPR and MAXR and the flag RSPF are provided in the working memory 28.

Next, the data in the register MAXR is written into a head address BHA of the block 0 within the memory 30 in a step 42. Due to the initialization in the step 40, the value of the write-in data is "0". Thereafter, the present process advances to a step 44 wherein the address value of the address pointer IP is increased by one. As a result, the address pointer IP assigns an address next to the head address BHA of the block 0 within the memory 30.

Figure 8:
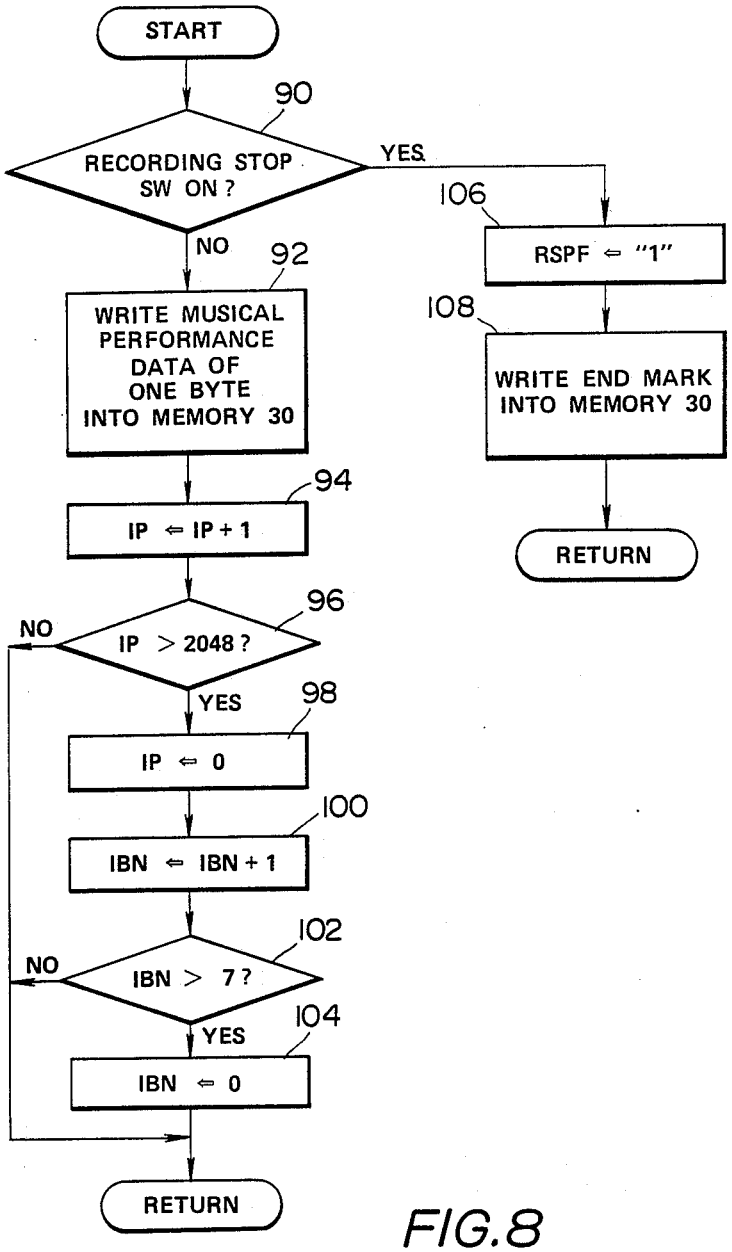
FIG. 8 is a flow chart showing an event interruption routine.

Next, an event interruption is permitted so that the routine shown in FIG. 8 becomes able to be performed in a step 46. The routine shown in FIG. 8 is performed every time when the electronic musical instrument 10 generates the interruption command pulse INP, and detailed description thereof will be given later. After the process in the step 46 is completed, the present process will advance to a step 48.

The step 48 judges whether the value of the block pointer IBN is equal to another value of another block pointer OBN or not. The values of the block pointers IBN and OBN are both equal to "0", just after the event interruption is permitted in the step 46. Hence, the judgment result of the step 48 is affirmative (Y) so that the present process will advance to a step 50.

The step 50 judges whether the value of the flag RSPF is equal to "1" or not (whether the recording stop switch is turned on or not). When the value of the flag RSPF is equal to "0", a judgment result of the step 50 is negative (N) so that the present process will be back to the step 48. The processes of the steps 48 and 50 are repeatedly performed so that the value of the block pointer IBN will become "1" by the routine shown in FIG. 8. Hence, the judgment result of the step 48 becomes negative (N), and the present process will advance to the step 52.

The step 52 performs a process for recording the data of one block on the disk 32A. In other words, a step 54 within the step 52 judges whether the data indicated by the address pointer OP is the end mark data or not. When the judgment result of the step 54 is negative (N), the present process will advance to the step 56 wherein the data of one byte stored in the memory 30 is transferred to and recorded on the disk 32A. Since the values of the pointers OBN, OP, FDIBP and FDIP are set to "0" at first, the data (having a value of "0") stored in the head address of the block 0 within the memory 30 is recorded at the head address DHA of the block 0 within the disk 32A. The values of the address pointers OP and FDIP are both increased by one in a step 58, and the present process advances to a step 60. The step 60 judges whether the value of the pointer OP is larger than 2048 or not (whether the data of one block is completely recorded or not). The judgment result of the step 60 is negative (N) just after the data in the head address BHA is recorded at the head address DHA on the disk 32A, hence, the present process will be back to the step 54. Thereafter, the processes of the steps 54 to 60 are repeatedly performed until the value of the pointer OP becomes larger than 2048. As a result, all data of the block 0 within the memory 30 are transferred to and recorded on the block 0 within the disk 32A. At this time, the judgment result of the step 60 becomes affirmative (Y), and the present process will advance to a step 62.

The value "0" is set to both of the address pointers OP and FDIP in the step 62. Then, the present process advances to a step 64 wherein the values of the block pointers FDIBP and OBN are increased by one. Thereafter, the present process will advance to a step 66 shown in FIG. 7B.

In FIG. 7B, a process for detecting the maximum block number MAX is performed in the step 66. More specifically, a step 68 in the step 66 calculates a difference between the value of the block pointer IBN (i.e., a block number at the write-in operation) and the value of the block pointer OBN (i.e., a block number at the read-out operation). The absolute value of this difference is stored in the temporary register TPR. This absolute value corresponds to a data quantity accumulated in the memory 30.

Next, a step 70 judges whether the value of the register TPR is larger than the value of the maximum block number register MAXR or not. The value "0" is stored in the register MAXR at first, hence, the judgment result of the step 70 is affirmative (Y) and the present process will advance to a step 72. The value of the register TPR is set to the register MAXR in the step 72. Then, the present process will advance to a step 74.

The step 74 judges whether the value of the pointer OBN is larger than seven or not (i.e., a series of the data of eight blocks are completely recorded or not). When a series of the data of one block are recorded, the judgment result of the step 74 becomes negative (N), hence, the present process will be back to a step 48 shown in FIG. 7A. When such processes are repeatedly performed and the judgment result of the step 74 becomes affirmative (Y), the present process will advance to a step 76.

The step 76 sets the value of the pointer OBN to "0" in order to continue the read-out operation performing from the block 7 to the block 0 within the memory 30 as described in "30A" shown in FIG. 3. The present process will advance from the step 76 to the former step 48, and the next data of eight blocks will be recorded. Such recording process described heretofore will be repeatedly performed thereafter.

When the judgment result of the step 70 becomes negative (N) in the above recording process, the present process will advance from the step 70 to the step 74. Therefore, the register MAXR finally stores the data indicating the maximum block number MAX corresponding to a maximum quantity of the data accumulated in the memory 30 in a one data transfer cycle between a start time of the musical performance and an end time of the musical performance.

In the case where the recording stop switch is turned on, the routine shown in FIG. 8 sets the value of the flag RSPF to "1". At the same time, the end mark data is written into the memory 30, and thereafter, the write-in operation for the memory 30 is stopped. At this time, the value of the pointer IBN becomes un-changeable. In FIG. 7A, when the value of the pointer OBN becomes equal to the value of the pointer IBN, the judgment result of the step 48 becomes affirmative (Y), hence, the present process will advance to the step 50.

In this case, the value of the flag RSPF is equal to "1", hence, the judgment result of the step 50 becomes affirmative (Y) and the present process will advance to the step 78. The step 78 inhibits the event interruption so that the routine shown in FIG. 8 is rendered non-executable, and the present process will advance to the step 54.

The step 54 judges whether the data indicated by the address pointer OP is the end mark data or not. Generally, the read-out operation of the memory 30 is slower than the write-in operation of the memory 30. Hence, the read-out operation does not advance to read out the end mark data when the recording process is stopped. For this reason, the judgment result of the step 54 becomes negative (N), and the present process will advance to the step 56. As described before, a series of the musical performance data remained in the memory 30 are transferred to and recorded on the disk 32A.

The recording process progresses and the pointer OP will points the end mark data. At this time, the judgment result of the step 54 becomes affirmative (Y), and the present process will advance to a step 80 shown in FIG. 7C.

In FIG. 7C, the step 80 performs a recording process for recording the maximum block number MAX on the disk 32A. More specifically, a step 82 within the step 80 sets the value of the block pointer FDIBP to "0", and present process advances to a step 84 wherein all data of the block 0 within the disk 32A are transferred to and stored in the block 0 within the memory 30. Next, a step 86 writes the value of the register MAXR (i.e., the maximum block number MAX) into the head address BHA of the block 0 within the memory 30. Thereafter, the present process advances to a step 88 wherein all data of the block 0 within the memory 30 are transferred to and recorded on the block 0 within the disk 32A. As a result, the data indicating the maximum block number MAX is recorded on the head address DHA of the disk 32A, hence, the recording process is ended.

EVENT INTERRUPTION ROUTINE (shown in FIG. 8)

FIG. 8 shows an event interruption routine. This event interruption routine is started at every time when the interruption command pulse INP is generated in synchronism with a timing when the electronic musical instrument 10 generates the musical performance data of one byte in a cycle in which the event interruption is permitted.

First, a step 90 judges whether the recording stop switch (SW) is turned on or not. If the judgment result of the step 90 is negative (N), the present process advances to a step 92 wherein the musical performance data of one byte is written into the memory 30. In this case, the write-in addresses are assigned by the block pointer IBN and the address pointer IP. For example, above musical performance data of one byte is written into the addresses next to the head address BHA of the block 0 within the memory 30 just after the event interruption is permitted in the step 46 shown in FIG. 7A.

Next, a step 94 increases the value of the pointer IP by one, and the present process advances to a step 96. The step 96 judges whether the value of the pointer IP is larger than 2048 or not (i.e., the data of one block is completely written into the memory 30 or not). When the musical performance data is written into the addresses next to the head address BHA as described before, the judgment result of the step 96 becomes negative (N), and the present process will return to the routine shown in FIGS. 7A to 7C.

Similarly, a series of musical performance data are written into the memory 30 at every time when the interruption command pulse INP is generated, so that a series of musical performance data are stored in the block 0 within the memory 30 as shown in FIG. 3. Thereafter, the judgment result of the step 96 becomes affirmative (Y), and the present process will advance to a step 98.

The step 98 sets the value of the pointer IP to "0". The value of the pointer IBN is increased by one in a step 100, and the present process advances to a step 102. The step 102 judges whether the value of the pointer IBN is larger than seven or not (the data of eight blocks is completely written into the memory 30 or not). When the write-in operation for the block 0 is completed, the judgment result of the step 102 becomes negative (N), hence, the present process will return to the routine shown in FIGS. 7A to 7C. When the above write-in operation is repeatedly performed so that the value of the pointer IBN becomes larger than seven, the judgment result of the step 102 becomes affirmative (Y), and the present process will advance to a step 104.

The step 104 sets the value of the pointer IBN to "0" so as to continue the write-in operation between the block 7 and the block 0 within the memory 30 as shown by "30A" in FIG. 3. After the process of the step 104 is completed, the present process will return to the routine shown in FIGS. 7A to 7C.

When the recording stop switch is turned on, the judgment result of the step 90 becomes affirmative (Y), and the present process will advance to a step 106. The step 106 sets the value of the flag RSPF to "1". Then, the present process advances to a step 108 wherein the end mark data is written into the address (i.e., the end order of the musical performance data) assigned by the pointers IBN and IP in the memory 30. Thereafter, the present process will return to the routine shown in FIGS. 7A to 7C.

Figure 9A:
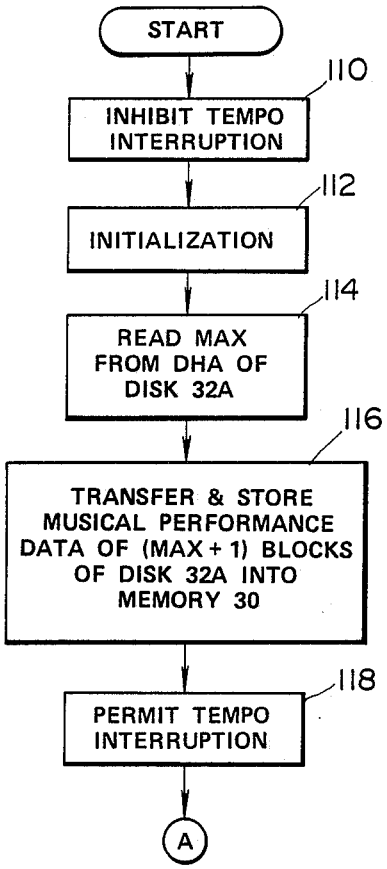
FIGS. 9A and 9B are flow charts showing a main routine of the reproducing process.
Figure 9B:
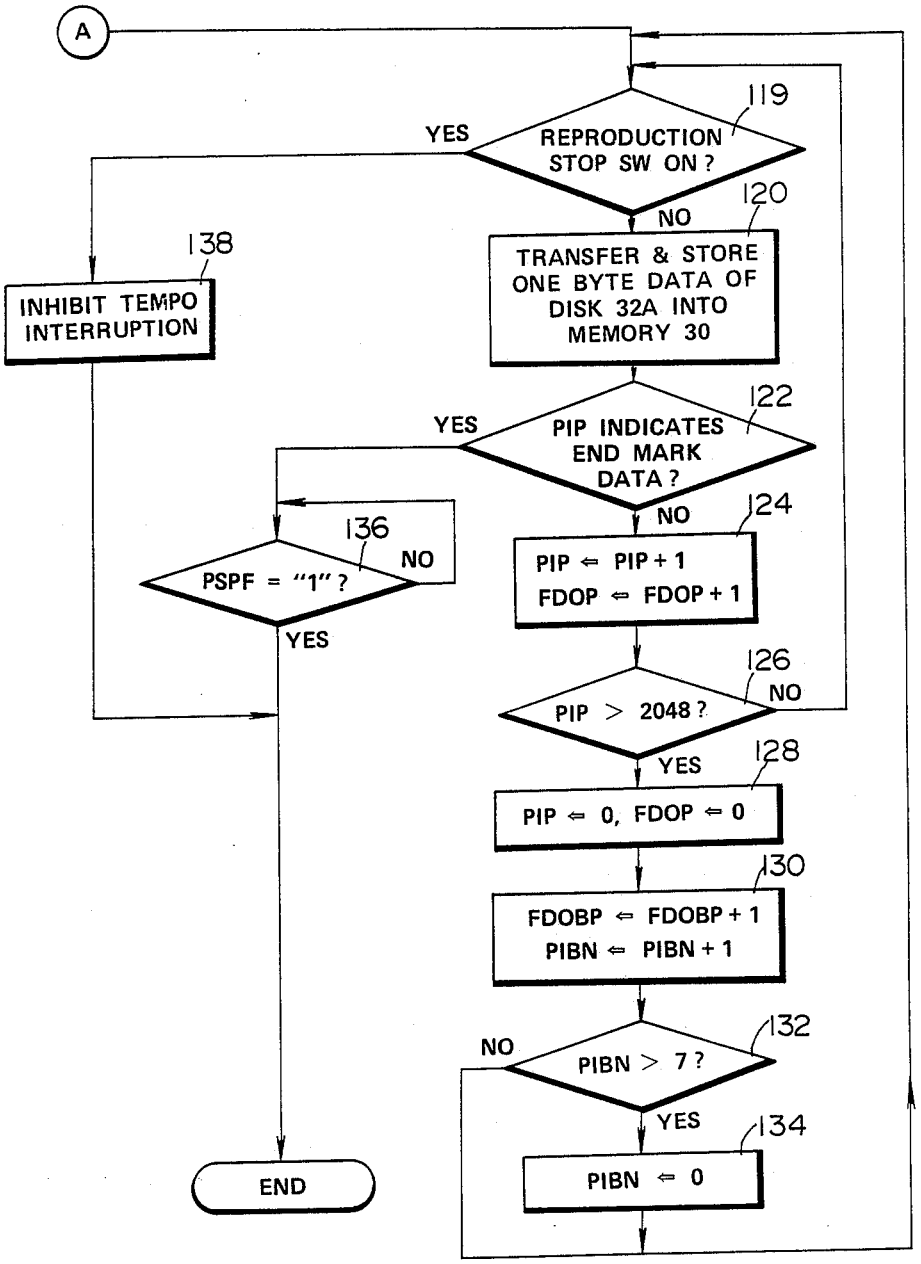

MAIN ROUTINE FOR REPRODUCING PROCESS (shown in FIGS. 9A and 9B)

FIGS. 9A and 9B show a main routine for the reproducing process. This main routine is started by that the reproduction switch is turned on.

Figure 10A:
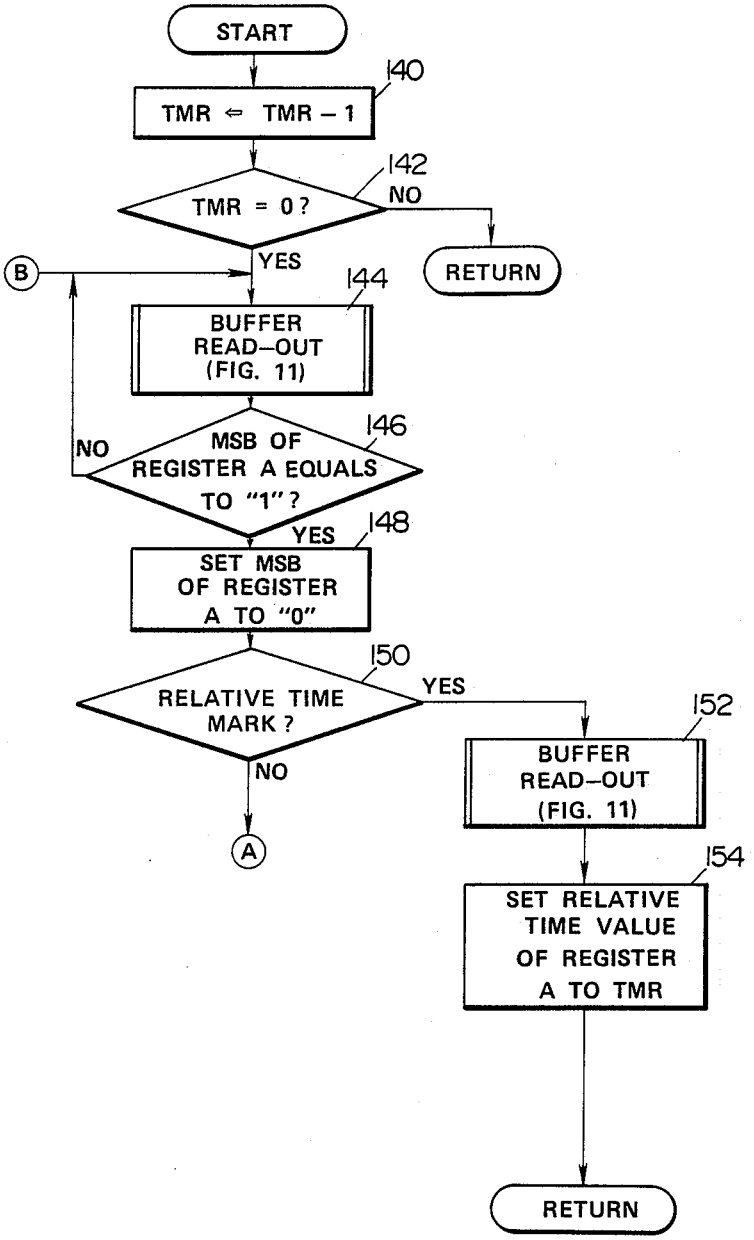
FIGS. 10A and 10B are flow charts showing a tempo interruption routine.
Figure 10B:
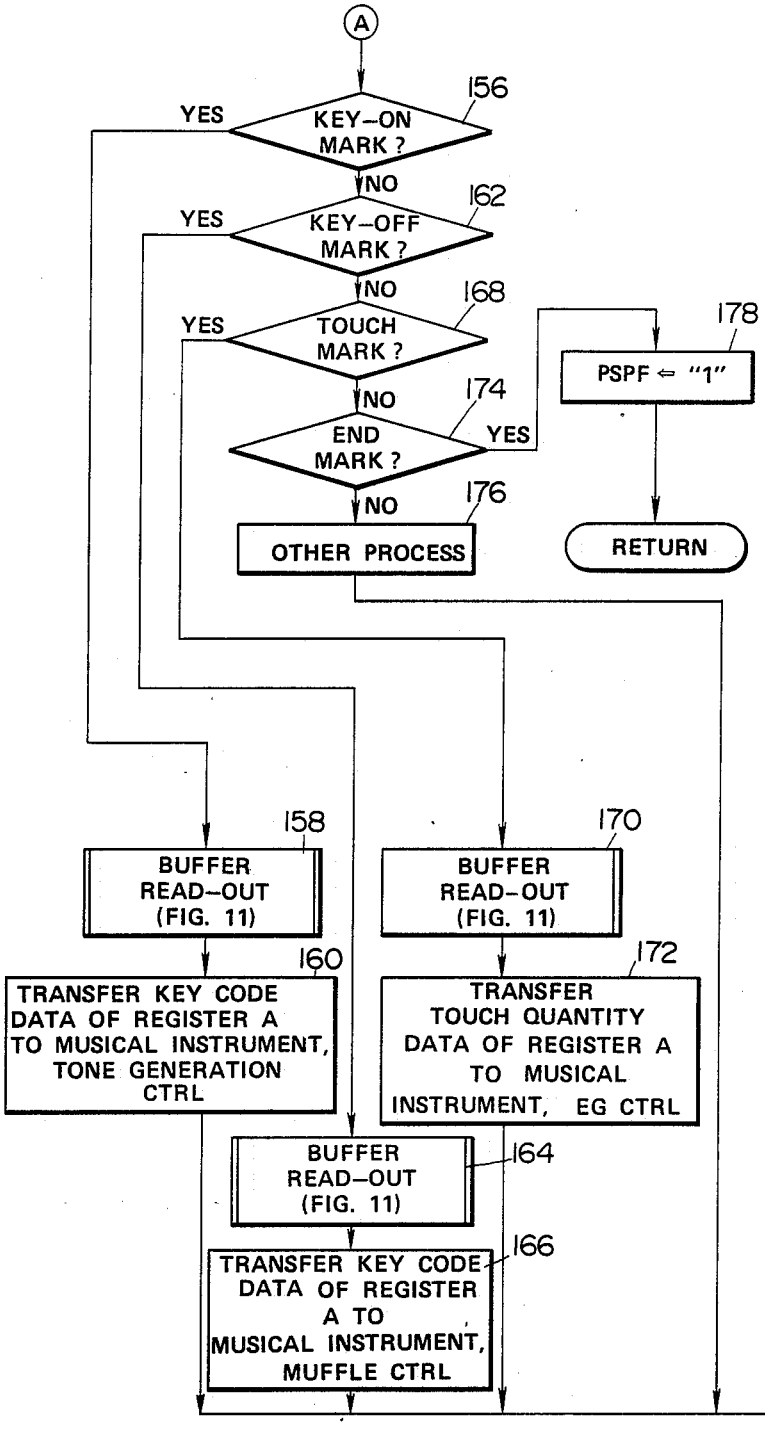

In FIG. 9A, a step 110 inhibits the tempo interruption so as to make the tempo interruption routine shown in FIGS. 10A and 10B non-executable. Thus, the musical performance data can be transferred from the disk 32A to the memory 30 wherein the musical performance data can be stored therein.

Next, a step 112 performs a process for an initialization. More specifically, the buffer memory 30 is cleared and the magnetic disk recording apparatus 32 is made reproducible. In addition, registers in the working memory 28 are initialized. For example, the values of the former pointers FDOBP, FDOP, PIBN, PIP, POBN and POP are all set to "0", and the value "0" is set to a reproduction stop flag PSPF, a register TMR for measuring the relative time and a read-out data register A. These flag PSPF, registers TMR and A are provided in the working memory 28. After the process of the step 112 is completed, the present process will advance to a step 114.

The data indicating the maximum block number MAX is read from the head address DHA of the block 0 within the disk 32A in the step 114. And, the present process advances to a step 116 wherein a series of musical performance data of (MAX+1) blocks are sequentially transferred from the disk 32A to the memory 30 and are stored in the memory 30.

Next, a step 118 permits the tempo interruption so as to make the routine shown in FIGS. 10A and 10B executable. Thereafter, a step 119 shown in FIG. 9B judges whether a reproduction stop switch (SW) is turned on or not. When the judgment result is negative (N), the present process advances to a step 120 wherein the data of one byte from the disk 32A is transferred to and stored in the memory 30. In this case, the read-out addresses of the disk 32A are assigned by the pointers FDOBP and FDOP, and the write-in addresses of the memory 30 are assigned by the pointers PIBN and PIP. When the present process advance first to a step 120 from the step 116 via the steps 118 and 119, the pointers FDOBP and PIBN both assign the block number next to the block number assigned finally in the step 116. In addition, the pointers FDOP and PIP both point to the address value "0". Hence, if the additional result of MAX+1 equals to "5", the data read from the disk 32A is written into the head address of the block 6 within the memory 30. Thereafter, the present process will advance to a step 122 from the step 120.

The step 122 judges whether the data indicated by the pointer PIP is the end mark data or not. When the judgment result of the step 122 is negative (N), the present process advances to a step 124 wherein the values of the pointers PIP and FDOP are increased by one. Next, a step 126 judges whether the value of the pointer PIP is larger than 2048 or not (i.e., the write-in operation for one block is completed or not). When the judgment result of the step 126 is negative (N), the present process will return to the step 119, hence, the processes of the steps 119 to 126 are repeatedly performed.

When the write-in operation for one block is completed, the judgment result of the step 126 becomes affirmative (Y), and the present process will advance to a step 128. In the step 128, the values of the pointers PIP and FDOP are both set to "0". Next, a step 130 increases the values of the pointers FDOBP and PIBN by one. Thereafter, the present process will advance to a step 132.

The step 132 judges whether the value of the pointer PIBN is larger than seven or not (i.e., the write-in operation for eight blocks is completed or not). If the judgment result of the step 132 is negative (N), the present process will return to the former step 119, and the processes of the steps 119 to 132 will be repeatedly performed. Thereafter, the judgment result of the step 132 becomes affirmative (Y), and the present process will advance to a step 134.

The value of the pointer PIBN is set to "0" in the step 134, and the present process will return to the step 119. As a result, the write-in operation for the block 7 is completely performed, and thereafter, the write-in operation for the block 0 is continuously performed.

When the end mark data is written into the memory 30 in the above transfer process, the judgment result of the step 122 becomes affirmative (Y), and the present process will advance to a step 136. The step 136 judges whether the value of the flag PSPF is equal to "1" or not. The value of the flag PSPF is set to "1" when the end mark data are read from the memory 30 in a routine shown in FIGS. 10A and 10B. Generally, the judgment result of the step 136 is negative (N) just after the end mark data is written into the memory 30, hence, the judging process of the step 136 is repeatedly performed. Thereafter, when the value of the flag PSPF becomes "1" in a routine shown in FIGS. 10A and 10B, the judgment result of the step 136 becomes affirmative (Y), hence, the reproducing process will be ended.

In the case where the reproduction stop switch is turned on in the reproducing cycle, the judgment result of the step 119 becomes affirmative (Y), and the present process will advance to a step 138. In the step 138, the tempo interruption is inhibited, and thereafter, the reproducing process will be ended. In this case, therefore, it is inhibited to perform a data transfer operation from the disk 32A to the memory 30 and it is also inhibited to perform the read-out operation from the memory 30 (i.e., it is inhibited to perform the performance reproduction).

TEMPO INTERRUPTION ROUTINE (shown in FIGS. 10A and 10B)

FIGS. 10A and 10B show the tempo interruption routine. This tempo interruption routine is started at every time when the tempo clock generator 34 generates the tempo clock pulse TCL in a cycle in which the tempo interruption routine is permitted.

In FIG. 10A, a step 140 decreases the value of the register TMR for measuring the relative time by one. Next, a step 142 judges whether the value of the register TMR is equal to "0" or not. When the judgment result of the step 142 is negative (N) so that the relative time has not been passed away, the present process returns to the routine shown in FIGS. 9A and 9B. On the other hand, when the judgment result of the step 142 is affirmative (Y), the present process will advance to a step 144.

Figure 11:
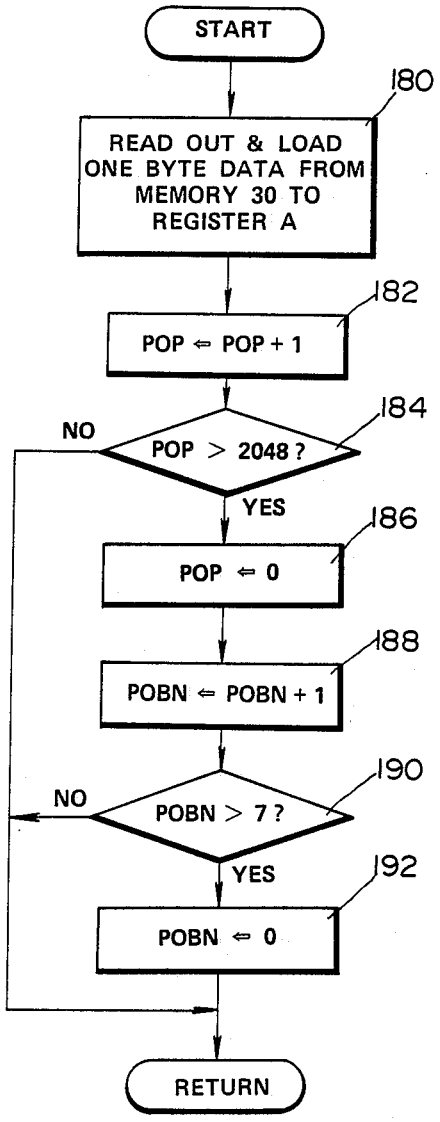
FIG. 11 is a flow chart showing a subroutine for a buffer read-out operation.

The step 144 executes a subroutine for a buffer read-out shown in FIG. 11, so that the data of one byte is read from the memory 30 and is supplied to the register A. In this case, the read-out addresses are assigned by the pointers POBN and POP.

Next, a step 146 judges whether the MSB of the data stored in the register A is "1" or not (i.e., the data stored in the register A is the mark data or not). When the judgment result of the step 146 is negative (N), the present process returns to the former step 144 so as to read out the next data of one byte. When the judgment result of the step 146 is affirmative (Y), the present process will advance to a step 148.

In the step 148, the MSB of the data stored in the register A is set to "0". Hence, it becomes possible to perform a comparing operation based on reference data in which the MSB thereof is "0" in judgment processes of the following steps 150, 156, 162, 168 and 174. Thereafter, the present process will advance to a step 150.

The step 150 judges whether the data stored in the register A is the relative time mark data or not. When the judgment result of the step 150 is affirmative (Y), the present process will advance to a step 152 wherein the routine shown in FIG. 11 is performed. As a result, the relative time value data is read out and stored in the register A. Next, the relative time value data of the register A is stored in the register TMR in a step 154. Thereafter, the present process will return to the routine shown in FIGS. 9A and 9B. The relative time value data indicates the relative time between the events based on the number of pulses of the tempo clock pulse TCL. Hence, the value of the register TMR is decreased by one in the former step 140 at every time when the tempo interruption is performed, so that it becomes possible to reproduce the relative time between the events.

When the judgment result of the step 150 is negative (N), the present process will advance to a step 156 shown in FIG. 10B. The step 156 judges whether the data of the register A is key-on mark data or not. When the judgment result of the step 156 is affirmative (Y), the present process advances to a step 158 wherein the routine shown in FIG. 11 will be performed. As a result, key code data of UK, LK or PK is read out and stored in the register A. In a step 160, the key code data of the register A is supplied to the electronic musical instrument 10 so as to control a generating of a musical tone corresponding to this key code data. Thereafter, the present process will return to the former step 144 shown in FIG. 10A.

When the judgment result of the step 156 shown in FIG. 10B is negative (N), the present process advances to a step 162. The step 162 judges whether the data of the register A is key-off mark data or not. When the judgment result of the step 162 is affirmative (Y), the present process advances to a step 164 wherein the routine shown in FIG. 11 is performed. As a result, the key code data of UK, LK or PK is read out and stored in the register A. In a next step 166, the key code data of the register A is supplied to the electronic musical instrument 10 so as to control a muffling of a musical tone corresponding to this key code data. Thereafter, the present process will return to the step 144 shown in FIG. 10A.

When the judgment result of the step 162 shown in FIG. 10B is negative (N), the present process will advance to a step 168. The step 168 judges whether the data of the register A is touch mark data or not. When the judgment result of the step 168 is affirmative (Y), the present process advances to a step 170 wherein the routine shown in FIG. 11 is performed. As a result, the touch quantity data is read out and stored in the register A. In a next step 172, the touch quantity data of the register A is supplied to the electronic musical instrument 10 so as to control an envelope generator (EG) which is not shown in the drawings. Thereafter, the present process will return to the former step 144 shown in FIG. 10A.

When the judgment result of the step 168 is negative (N), the present process advances to a step 174. The step 174 judges whether the data of the register A is the end mark data or not. When judgment result of the step 174 is negative (N), the present process advances to a step 176 wherein other process (such as a process concerning the operating member for controlling the musical tone, for example). Thereafter, the present process will return to the former step 144 shown in FIG. 10A.

When the judgment result of the step 174 is affirmative (Y), the present process advances to a step 178 wherein the value of the flag PSPF is set to "1". Thereafter, the present process will return to the routine shown in FIGS. 9A and 9B.

SUBROUTINE FOR BUFFER READ-OUT (shown in FIG. 11)

The routine shown in FIG. 11 is provided for reading out the data of one byte from the buffer memory 30.

In FIG. 11, the data of one byte is read from the memory 30 and is loaded to the register A in a step 180. At this time, the read-out addresses are assigned by the pointers POBN and POP.

Next, the value of the pointer POP is increased by one in a step 182, and the present process will advance to a step 184. The step 184 judges whether the value of the pointer POP is larger than 2048 or not (i.e., the read-out operation for one block is completed or not). When the judgment result of the step 184 is negative (N), the present process will return to the routine shown in FIGS. 10A and 10B.

When the judgment result of the step 184 is affirmative (Y), the present process advances to a step 186 wherein the value of the pointer POP is set to "0". Next, the value of the pointer POBN is increased by one in a step 188, and the present process will advance to a step 190. The step 190 judges whether the value of the pointer POBN is larger than seven or not (the read-out operation for eight blocks are completed or not). When the judgment result of the step 190 is negative (N), the present process will return to the routine shown in FIGS. 10A and 10B.

On the other hand, when the judgment result of the step 190 is affirmative (Y), the present process advances to a step 192 wherein the value of the pointer POBN is set to "0", and thereafter, the present process will return to the routine shown in FIGS. 10A and 10B. As a result, the read-out operation is continuously performed on the block 0 next to the block 7.

Above is the whole description of the invention. This invention may be practiced or embodied in still other ways without departing from the spirit or essential character thereof.

For instance, the maximum block number data corresponding to the maximum quantity of the data accumulated in the buffer memory 30 is used as a transfer control information in response to a musical performance information quantity of a predetermined cycle. However, it is possible to alternately use event number data having the maximum event number within a group of the event number data which are obtained by repeatedly counting the event number when the musical instrument is played. Furthermore, it is possible to alternately use average transfer speed data which is obtained by dividing all event number by the value of playing time when the musical instrument is played. In addition, the recording medium is not limited to the magnetic disk, and it is possible to alternately use a magnetic tape, semiconductor memory and other recording mediums.

Therefore, the preferred embodiment described herein are illustrative and not restrictive, the scope of the invention being indicated by the appended claims and all variations which come within the meaning of the claims are intended to be embraced therein.

What is claimed is:

1. An automatic musical performance apparatus for an electronic musical instrument comprising:

(a) a memory for writing in musical performance data groups supplied from said electronic musical instrument and for reading out said musical performance data groups;

(b) a recording medium for recording said musical performance data groups which are read out from said memory;

(c) writing means for sequentially writing said musical performance data group into said memory;

(d) first recording means for recording said musical performance data groups on said recording medium, said musical performance data groups being read from said memory while groups are being written into said memory by said writing means;

(e) detecting means for detecting transfer control information which is determined from the data quantity of those of said musical performance data groups which are transferred in a unit time when said electronic musical instrument is played;

(f) second recording means for recording said transfer control information on a predetermined area arranged on said recording medium;

(g) first transfer means for reading out said transfer control information from said recording medium before said musical performance data groups are reproduced, a first musical performance data group of said quantity within said musical performance data groups being read from said recording medium and being written into said memory during a waiting period;

(h) second transfer means for sequentially reading out remaining musical performance data groups other than said first musical performance data group from said recording medium after said waiting period has passed; and (i) reproducing means for reproducing said musical performance data groups which are sequentially read from said memory after said waiting period has passed.

2. An automatic musical performance apparatus according to claim 1, wherein said data quantity differs for each musical tune which is to be played by said electronic musical instrument, said waiting period being determined based on said data quantity so that said waiting period differs for each musical tune.

3. An automatic musical performance apparatus according to claim 1, wherein said transfer control information is an average transfer speed Va of said musical performance data groups, said average transfer speed Va being determined by a formula $Va=E/T$, where E represents the number of events occurred at playing an T denotes a time required for playing.

4. An automatic musical performance apparatus according to claim 1, wherein said memory is constituted by a RAM.

5. An automatic musical performance apparatus according to claim 1 further comprising a CPU, a working memory and a program memory, said program memory pre-storing programs for executing processes of said writing means, said first recording means, said detecting means, said second recording means, said first transfer means, said second transfer means and said reproducing means therein, said working memory being provided with pointers for assigning read-out and write-in addresses for said memory and said recording medium, and said CPU executing said programs by use of said read-out and write-in addresses.

6. An automatic playing musical instrument according to claim 5, wherein said working memory is constituted by a RAM and said program memory is constituted by a ROM.

7. An automatic playing musical instrument according to claim 1, wherein a data storing portion of said memory is divided into M (where M represents a positive integral number) memory blocks and a data recording portion of said recording medium is divided into N (where N represents a positive integral number) memory blocks each of which corresponds to each memory block of said memory, a series of said M memory blocks being repeatedly used for reading out and writing in said musical performance data groups in a predetermined order.

8. An automatic playing musical instrument according to claim 7, wherein maximum block number data indicating the number of memory blocks within said M memory blocks is recorded at a head address of a first memory block of said recording medium, said maximum block number data corresponding to a maximum data quantity of said musical performance data groups which are accumulated in said memory when said musical performance data groups are recorded on said recording medium, and said unit data quantity being determined based on said maximum block number data.

9. A method for storing, on a recording medium music performance data for automatic playback of a musical performance or an electronic musical instrument, comprising the steps of:

producing music performance data corresponding to a particular musical performance using the electronic musical instrument;

sequentially transferring the produced music performance data to a buffer memory for temporary storage at a transfer rate dependent on the particular musical performance, the buffer memory having a data transfer capability greater than that of said recording medium;

sequentially transferring data from the buffer memory to recording medium;

determining transfer control information representing a wait time for initially loading the buffer memory with data from the recording medium, the transfer control information being dependent on said transfer rate; and storing the determined tranfer control information in the recording medium at a designated memory location.

10. A method as in claim 9 further comprising the steps of:

reading the stored transfer control information from the record medium to determine wait time in a subsequent automatic performance mode;

transferring data from the recording medium to the buffer memory for a period equal to the determined wait time in the automatic performance mode; and subsequently transferring data from the first memory to be applied to play the electronic musical instrument to reproduce the music tune while additional data is being continuously transferred from the second memory to the first memory.

11. A method as in claim 10 wherein the transfer control information is determined according to the maximum amount of data accumulated in the buffer memory encountered throughout data transfer into and out of the buffer memory caused by difference in rates of data transfer into and out of the buffer memory.

12. A method as set out in claim 9, wherein said musical performance data corresponds to key events of said musical performance.

13. A method as set out in claim 9, wherein said buffer memory is a random access memory.

14. A musical performance apparatus for automatically performing musical performance data generated by an electronic musical instrument comprising:

a buffer memory;

a recording medium;

means for providing musical performance data generated by the electronic musical instrument to the buffer memory for temporary storage therein;

means for reading out and transferring musical performance data from the buffer memory to the recording medium to be recorded thereon;

means for controlling reading and storing operations of the buffer memory and the recording medium for detecting transfer control information corresponding to a data quantity which represents the quantity of data transferred in a unit time, and for recording the transfer control information at a predetermined area of the recording medium; and means for reading from the recording medium the transfer control information, for reading and transferring an amount of musical performance data, in accordance with the transfer control information, from the recording media to the buffer memory to be temporarily stored, and for reading and transferring remaining musical performance data in the recording medium to the buffer memory as previously stored musical performance data are read from the buffer memory to be reproduced in an automatic musical performance.

* * * * *